United States Patent [19]

Darwin et al.

[11] 3,987,883

[45] Oct. 26, 1976

[54] RIBBON LIFTING MECHANISM FOR A WIRE MATRIX PRINTER

[75] Inventors: Daniel P. Darwin, Saratoga, Calif.; Donald K. Rex, Delray Beach, Fla.

[73] Assignee: International Business Machines Corporation, Armonk, N.Y.

[22] Filed: Apr. 17, 1975

[21] Appl. No.: 568,961

[52] U.S. Cl. ..... 197/1 R; 197/151; 197/170

[51] Int. Cl.[2] ..... B41J 3/04

[58] Field of Search ..... 197/1 R, 151, 170, 153 R, 197/153 A, 154, 157, 159, 160, 168, 169, 180, 181, 181.2; 101/93.04, 93.05

[56] References Cited

UNITED STATES PATENTS

| | | | |
|---|---|---|---|
| 3,726,381 | 4/1973 | Murphy | 197/151 X |
| 3,750,792 | 8/1973 | Liles | 197/1 R |
| 3,788,442 | 1/1974 | Lehnhardt et al. | 197/151 X |
| 3,822,005 | 7/1974 | Murat | 197/1 R |
| 3,881,587 | 5/1975 | Okabe | 197/1 R |
| 3,904,015 | 9/1975 | Boyden et al. | 197/151 |

*Primary Examiner*—Ralph T. Rader
*Attorney, Agent, or Firm*—John C. Black; D. Kendall Cooper; J. Jancin

[57] ABSTRACT

An improved mechanism is provided for preventing long-term oil contamination of the print ribbon in a wire matrix printer. In the event that the print ribbon has an excess of oil thereon, it will cause the printed characters to be alternatively too light or too dark thereby reducing the print quality on the document. The print head of the wire matrix printer is operated to an idle or at rest position when printing is not being effected, a camming mechanism retracts the print head away from the platen and document. When this occurs, a stationary member on the printer carriage engages the ribbon and moves it away from contact with the print head in the vicinity of the apertures through which the print wires are guided for printing. With the ribbon moved away from the apertures, the lubricant oils on the print wires do not flow on to the ribbon. The retracting of the print head away from the platen and document by the camming mechanism also permits the easy insertion of new forms into the printer.

6 Claims, 7 Drawing Figures

RIBBON LIFTING MECHANISM FOR A WIRE MATRIX PRINTER

BACKGROUND OF THE INVENTION

The improvement involves the use of a simplified mechanism for preventing the contamination of an endless ribbon by the lubricating oils on the print wires of a wire matrix printer.

The problem solved by this invention is the result of a unique set of circumstances. In order to print rapidly with a wire matrix printer, it is necessary to move the wires very short distances, i.e., in the order of 0.020 inches to 0.030 inches. This means that the ribbon must lie in a very short gap between the ends of the print wires and the document forms being printed on. In addition, the print wires are held within and are guided by a member that must position them accurately for the life of the printer. In order to prevent undue wear of the wires and guide member, it is necessary to provide lubrication in guide member openings through which the print wires are moved to engage the ribbon. Preferably the ribbon is held against the guide member and the ends of the print wires.

When the printer sits idle for an extended period of time such as a few hours, oil from the lubricating system can find its way from the print wires and guide member to the ribbon and cause a portion of the ribbon to be wetted. The oily portion of the ribbon can cause the printing to be either too light or too dark. The problem, therefore, is to find some inexpensive reliable means of keeping the ribbon free of oil when it is not in use for a number of hours.

At least one prior known solution suggested for this problem involved supporting the ribbon continuously at a short distance from the tip of the print head so that it could not become contaminated. This solution has been found to be marginal and small adjustments must be made periodically to assure the maintenance of a suitable gap at all times. In at least one known implementation of such an arrangement, the means for maintaining the ribbon away from the print head wire aperatures has been known to result in the accumulation of contaminating substances in the vicinity of the wire aperatures causing undersirable smudging on the documents. Also a wider gap is required between the guide member/print wires and the documents being printed on.

It is, therefore, a primary object of the present invention to provide an improved means for preventing the contamination of ribbons.

SUMMARY OF THE INVENTION

In order to prevent the contamination of the ribbon by lubricating oil, the present improvement has taken advantage of the fact that the print head of the wire printer is preferably spring-loaded toward the document forms and platen. This is particularly desirable in order to make the loading of new documents into the printer much easier. When the print head is retracted away from the document forms and platen, a stationary member or plunger, positioned so as to engage the ribbon, moves the ribbon away from the area of the guide member openings through which the print wires extend. With the ribbon physically removed from the area being lubricated, it is maintained in a substantially non-contaminated condition.

In the preferred embodiment of the invention, a camming means is provided for retracting the print head away from the platen when the printer is not being used. This camming mechanism is rendered effective when the print head is moved to an idle position. This idle position in the preferred embodiment is at one end of the carriage travel, i.e., to the left of the printing area.

At the end of a printing job or during any extended idle period, the print head in the preferred embodiment is moved to the idle position on one side of the printer. As the print head and carriage approach the idle position, the print head moves up a stationary ramp on the printer. As it moves up the ramp, the print head is forced away from the platen. This movement of the print head away from the platen is used to render the plunger effective. The plunger lies next to the print wires and lifts the ribbon away from the tips of the print wires a distance preferably in the order 50 to 60 thousandths of an inch. With the ribbon moved this far from the ends of the print wires and the guide member openings, it is not possible for the lubricant to reach it.

The foregoing and other objects, features and advantages of the present invention will be apparent from the following more particular description of the preferred embodiment of this invention as is illustrated in the accompanying drawings.

DESCRIPTION OF THE PREFERRED EMBODIMENT

The preferred embodiment of the present invention has been particularly adapted for use in a print head mechanism of the type shown and described in detail in the U.S. application for patent Ser. No. 423833 of D. P. Darwin et al filed on Dec. 11, 1973 and is entitled "Dot Printing Apparatus". Said application for patent is hereby incorporated herein by reference as if it were set forth in its entirety. It will be appreciated, however, that the improvement can be readily adapted for use with other print head mechanisms known in the art without the exercise of invention.

Briefly, the print wire impact members of the copending application are driven by electromagnetic means arranged in a circular pattern at the rear of a wire matrix print head. The wires are caused to converge following the arc of free bending in the wire from the circular array at the driver end to a parallel and colinear alignment at the printing or output end of the print head. The individual wires are continuously guided from the end where the drivers are located to a point where they are nearly parallel and colinear by utilizing an improved two-piece wire guide consisting of an inner cone with grooves on its surface and an outer shell which confines the wires to the grooves in the inner cone. The shape of the inner cone is such that the paths of the wires converge from a circular array at the driver end of the print head to a nearly colinear and parallel array at the output end of the print head.

Figure 1:
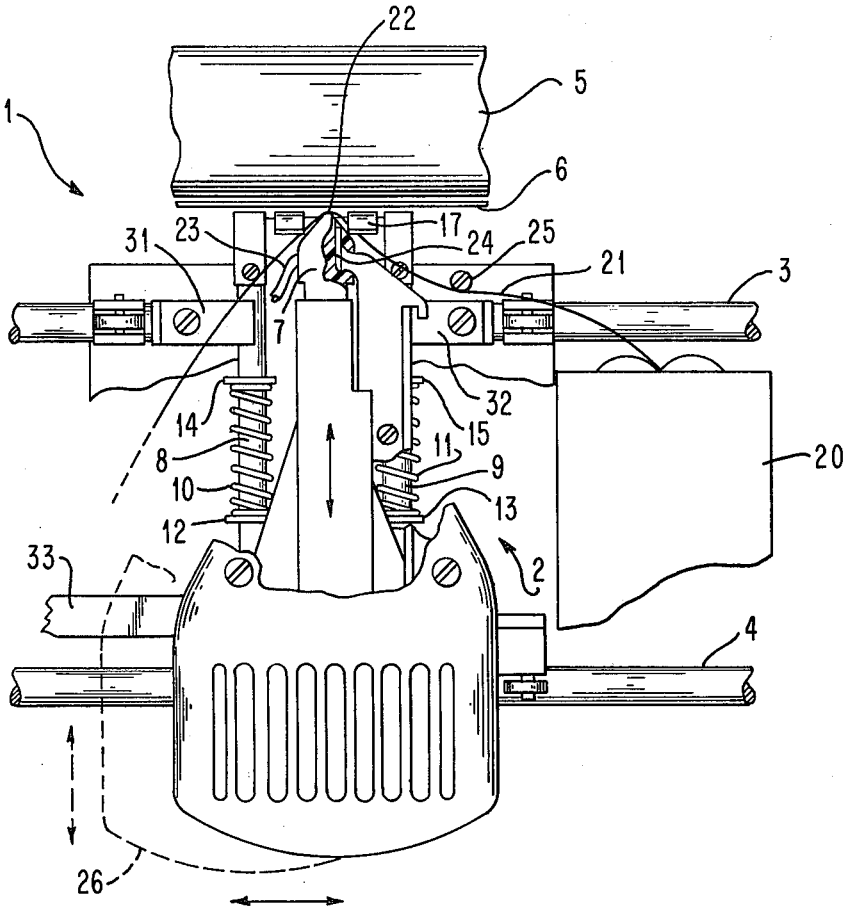
FIG. 1 is a fragmentary plan view of the print head and support mechanism of a wire matrix printer incorporating the improvement of the present application.

FIG. 1 illustrates a wire matrix printer 1 having a carriage mechanism 2 adapted for reciprocable movement on support shafts 3 and 4. A conventional platen 5 is positioned adjacent to and parallel with the supporting shaft 3. Documents 6 are received between the platen 5 and the carriage 2.

The carriage 2 supports a print head 7 by means of stationary brackets such as 31, 32 and shafts 8 and 9. The shafts 8 and 9 are perpendicular to the support shafts 3 and 4 and are slidable on bearing surfaces within the brackets 31, 32.

A pair of springs 10 and 11 are received on the shafts 8 and 9. Washers 12, 13, 14, 15 are received on the shafts 8 and 9 and retain the springs 10 and 11. Washers 12 and 13 bear against elements of the carriage 2 and the compressed springs 10 and 11 urge the head 7 toward the platen 5. As will be seen below, a camming means is provided for moving the print head 7 away from the platen 5 in an idle or at rest position of the carriage.

Figure 4:
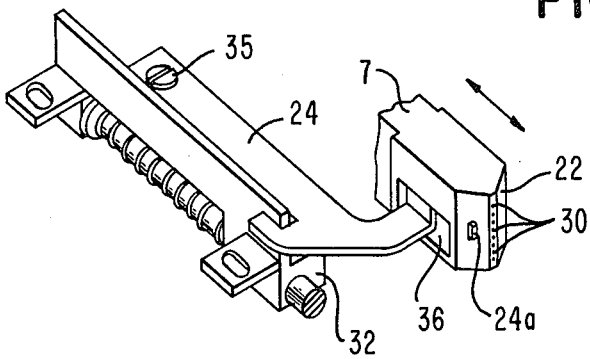
FIGS. 4 and 5 are fragmentary isometric views showing the plunger in its inoperative position and in its ribbon engaging position respectively.
Figure 5:
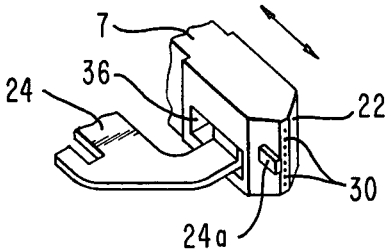
Figure 6:
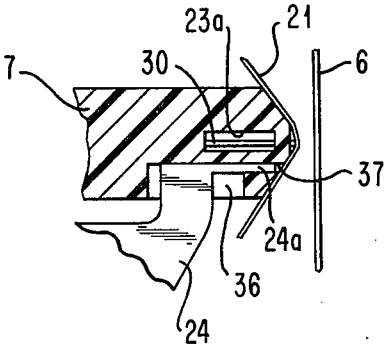
FIGS. 6 and 7 are fragmentary vertical sections of the print head illustrating the plunger in its inoperative and its ribbon engaging positions respectively.
Figure 7:
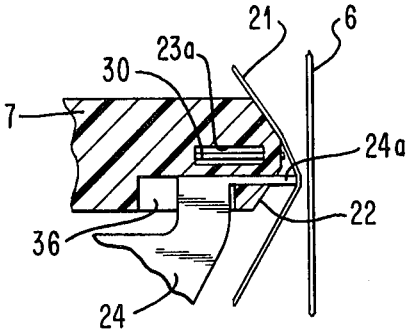

An endless ribbon cassette 20 having a suitable ribbon feed mechanism (not shown) is provided for supplying ribbon 21 to the print head. As seen in FIG. 1, the ribbon 21 is held in tight contact with the forward end or tip 22 of the print head 7. A lubricant is supplied to the print head 7 and the print wires 30 (FIG. 4) therein by means of a lubrication wick 23 and an internal cavity 23*a* in the head 7. A plunger 24 is provided for moving the ribbon 21 away from the print wires as will be seen in greater detail below. Suitable ribbon guides such as 25 are provided for directing the ribbon 21 across the print head 7.

A flat spring member 17 carried by the head 7 is adapted to engage the document 6 and space the document from the print wires 30 and ribbon 21.

The broken line 26 (FIG. 1) illustrates the position of the print head mechanism 7 when the carriage 2 is in its idle or at rest position. Each time the printing is halted and the printer 1 is idle, control circuits (not shown) cause the carriage 2 and its print head 7 to be moved to this idle position.

Figure 2:
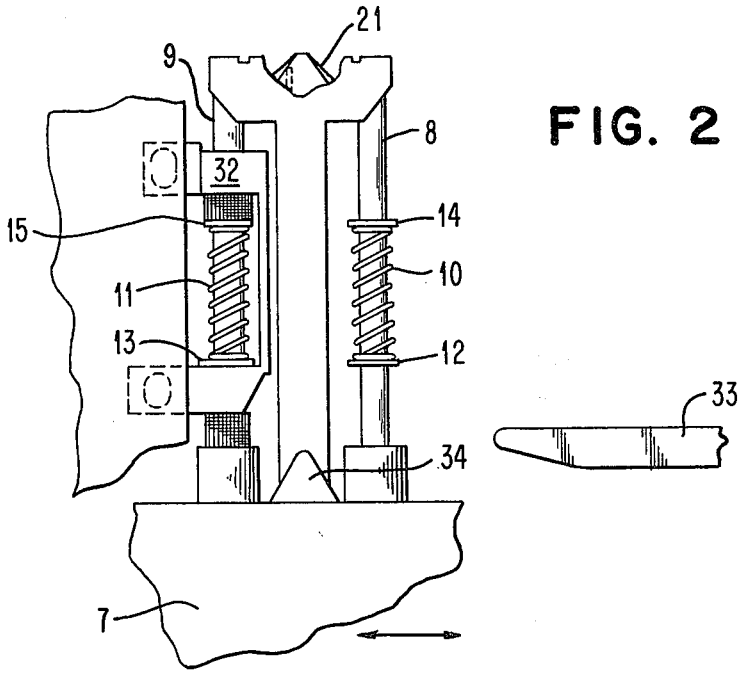
FIG. 2 is a fragmentary bottom view of a portion of the print head mechanism and the camming means for retracting it away from the platen.
Figure 3:
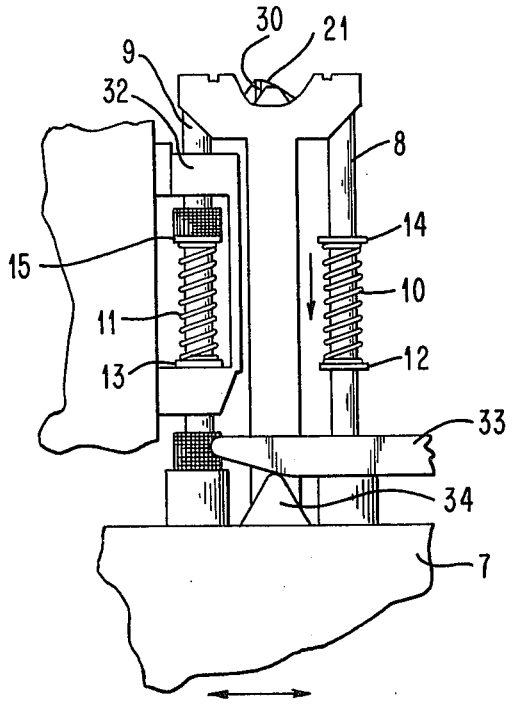
FIG. 3 is a fragmentary bottom view illustrating the print head mechanism in its retracted position.

FIGS. 2 and 3 shows the camming means for retracting the print head 7 away from the platen 5 (not shown) when the carriage 21 reaches the idle position. In FIG. 2, a cam lever 33 is shown out of engagement with a camming surface 34 on the head 7. FIG. 3 shows the cam lever 33 in engagement with the camming surface 34 while the carriage 2 is in its idle position. This camming action has moved the head 7 away from the platen 5 (not shown) and document 6 (not shown).

When this camming action moves the head 7 away from the platen 5, the stationary plunger 24, as seen in FIGS. 4 –7, engages the ribbon 21 to move it from engagement with the tip 22 of the head 7 in the immediate area of the print wires 30. The plunger 24 is secured to the bracket 32 on the carriage 2 by means of the screw 35, FIG. 4. The free end 24*a* of the plunger 24 is received within a cavity 36 (FIG. 7) in the head 7 and projects through an opening 37 (FIG. 6) in the tip 22 of the head 7.

It will be appreciated that conventional electromagnetic actuation of the plunger 24 can be used in place of the camming mechanism 33, 34, and that with this alternative scheme the plunger can be rendered effective in any position of the carriage to move the ribbon away from the tip 22 of the head 7.

While the invention has been particularly shown and described with reference to a preferred emodiment thereof, it will be understood by those skilled in the art that the foregoing and other changes in form and details may be made therein without departing from the spirit and scope of the invention.

What is claimed is:

1. In a wire matrix printer having a movable printer carriage supporting thereon a plurality of print wires, a print head having a tip portion with openings through which the print wires are reciprocally moved for printing, and ribbon held under tension in contact with the tip portion of the print head adjacent the openings and positioned to be engaged by the print wires as they reciprocate, the combination with said carriage and print head, a member having a portion thereof positioned adjacent to the print head wire openings and the ribbon, means mounting the print head and member for relative movement on the carriage in a direction generally transverse to the plane of the ribbon where the ribbon contacts the wire openings of the tip portion of the head, and means for producing relative movement of the print head and member to cause the member to engage the ribbon thereby separating the ribbon from the area of the wire openings on the print head.

2. The combination set forth in claim 1 wherein the mounting means holds the member stationary on the carriage and supports the head for reciprocal movement on the carriage toward and away from the ribbon, and wherein the means for producing relative movement comprises a cam surface on the head, and a cam member on the carriage adapted in an idle position of the carriage to engage said cam surface to move the head in a direction away from the ribbon.

3. In a wire matrix printer having a movable printer carriage supporting thereon a plurality of print wires, a print head having a tip portion with openings through which the print wires are reciprocally moved for printing, and ribbon held under tension in contact with the tip portion of the print head adjacent the openings and positioned to be engaged by the print wires as they reciprocate, the combination with said carriage and print head, a member having a portion thereof positioned adjacent to the print head wire openings and the ribbon;

means mounting the print head and member for relative movement on the carriage in a direction generally transverse to the plane of the ribbon where the ribbon contacts the wire openings of the tip portion of the head, wherein the mounting means holds the member stationary on the carriage and supports the head for reciprocal movement on the carriage toward and away from the ribbon: and means for producing relative movement of the print head and member to cause the member to engage the ribbon thereby separating the ribbon from the area of the wire openings on the print head, said means for producing relative movement including a cam surface on the head, and a cam member on the carriage adapted in an idle position of the carriage to engage said cam surface to move the head in a direction away from the ribbon; wherein the print head has a cavity therein and an additional opening from the cavity through the tip portion closely adjacent the wire openings, and wherein said member includes a projection thereon which is received within the head cavity and extends through said additional opening so as to engage the ribbon upon relative movement of the head and member.

4. In a wire matrix printer having a movable printer carriage supporting thereon a plurality of print wires, a print head having a tip portion with openings through which the print wires are reciprocally moved for printing, and ribbon held under tension in contact with the tip portion of the print head adjacent the openings and positioned to be engaged by the print wires as they reciprocate, the combination with said carriage and print head, a member having a portion thereof positioned adjacent to the print head wire openings and the ribbon, means mounting the print head and member for relative movement on the carriage in a direction generally transverse to the plane of the ribbon where the ribbon contacts the wire openings of the tip portion of the head, and means for producing relative movement of the print head and member to cause the member to engage the ribbon thereby separating the ribbon from the area of the wire openings on the print head, wherein the print head has a cavity therein and an additional opening from the cavity through the tip portion closely adjacent the wire openings, and wherein said member includes a projection thereon which is received within the head cavity and extends through said additional opening so as to engage the ribbon upon relative movement of the head and member.

5. In a wire matrix printer having a platen and a movable printer carriage supporting a plurality of print wires, a guide means having openings through which said wires are reciprocally moved for printing and a ribbon adapted to engage the guide means in an area around the openings, the combination with said carriage and guide means of a mechanism for disengaging the ribbon from the area around the openings in the guide means, said mechanism comprising, a member carried by the carriage and adapted to engage the ribbon in an area adjacent to guide means openings, and means for moving the member into engagement with the ribbon to disengage the ribbon from the guide means in the area around the openings.

6. In a wire matrix printer having a platen and a movable printer carriage supporting a plurality of print wires, a guide means having openings through which said wires are reciprocally moved for printing and a ribbon adapted to engage the guide means in an area around the openings, the combination with said carriage and guide means of a mechanism for disengaging the ribbon from the area around the openings in the guide means, said mechanism comprising, said guide means having a cavity therein and an additional opening from the cavity through the guide means closely adjacent the wire openings, a member carried by the carriage and including a projection thereon which is received within the cavity and extends through said additional opening so as to be adapted to engage the ribbon in an area adjacent to guide means openings, and means for producing relative movement of the member and guide means to cause the member to engage the ribbon, thereby disengaging the ribbon from the guide means in the area around the openings.

* * * * *